US007125612B2

(12) United States Patent
Ünal

(10) Patent No.: US 7,125,612 B2
(45) **Date of Patent: *Oct. 24, 2006**

(54) CASTING OF NON-FERROUS METALS

(75) Inventor: Ali Ünal, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/461,704

(22) Filed: Jun. 13, 2003

(65) Prior Publication Data

US 2003/0205357 A1 Nov. 6, 2003

Related U.S. Application Data

(63) Continuation-in-part of application No. 10/078,638, filed on Feb. 19, 2002, now Pat. No. 6,672,368.

(60) Provisional application No. 60/270,262, filed on Feb. 20, 2001.

(51) Int. Cl.

| | |
|---|---|
| ***B22F 3/18*** | (2006.01) |
| ***C22F 1/00*** | (2006.01) |
| ***B32B 5/16*** | (2006.01) |
| ***B32B 15/20*** | (2006.01) |
| ***B22D 11/112*** | (2006.01) |

(52) U.S. Cl. ..... 428/559; 428/614; 428/659; 428/660; 428/649; 148/522; 148/523; 148/538; 164/432; 164/433; 164/436

(58) Field of Classification Search ..... 148/522, 148/523, 538; 428/559, 614, 659, 660, 649; 164/432, 433, 436

See application file for complete search history.

(56) References Cited

U.S. PATENT DOCUMENTS

| | | | | |
|---|---|---|---|---|
| 4,002,197 | A | 1/1977 | Hazelett et al. | |
| 4,260,419 | A | 4/1981 | Robertson | |
| 4,282,044 | A | 8/1981 | Robertson et al. | |
| 4,751,958 | A | 6/1988 | Flowers et al. | 164/473 |
| 4,823,860 | A | 4/1989 | Lauener | |
| 4,915,158 | A | 4/1990 | Wood | 164/431 |
| 5,356,495 | A | 10/1994 | Wyatt-Mair et al. | |
| 5,470,405 | A | 11/1995 | Wyatt-Mair et al. | |
| 5,482,107 | A | 1/1996 | Judd | 164/480 |
| 5,496,423 | A | 3/1996 | Wyatt-Mair et al. | |
| 5,514,228 | A | 5/1996 | Wyatt-Mair et al. | |
| 5,515,908 | A | 5/1996 | Harrington | |
| 5,518,064 | A | 5/1996 | Romanowski et al. | |
| 5,564,491 | A | 10/1996 | Harrington | |
| 5,772,799 | A | 6/1998 | Sun et al. | |
| 5,772,802 | A | 6/1998 | Sun et al. | |
| 5,983,980 | A | 11/1999 | Freeman et al. | 164/480 |
| 6,193,818 | B1 | 2/2001 | Legresy et al. | |
| 6,280,543 | B1 | 8/2001 | Zonker et al. | |
| 6,344,096 | B1 | 2/2002 | Baumann et al. | |

OTHER PUBLICATIONS

Toshio Haga et al., "High Speed Roll Caster for Aluminum Alloy Strip", Proceedings of ICAA–6, Aluminum Alloys, vol. 1, pp. 327–332 (1998).

*Primary Examiner*—John J. Zimmerman
*Assistant Examiner*—Jason Savage
(74) *Attorney, Agent, or Firm*—Greenberg Traurig LLP; Harry A. Hild, Jr.

(57) ABSTRACT

A method of continuous casting non-ferrous alloys which includes delivering molten non-ferrous alloy to a casting apparatus. The casting apparatus rapidly cools at least a portion of the non-ferrous alloy at a rate of at least about 100° C. thereby solidifying an outer layer of the non-ferrous alloy surrounding an inner layer of a molten component and a solid component of dendrites. The dendrites are altered to yield cast product exhibiting good resistance to cracking.

31 Claims, 5 Drawing Sheets

CASTING OF NON-FERROUS METALS

RELATED APPLICATIONS

This application is a continuation-in-part of U.S. application Ser. No. 10/078,638 filed Feb. 19, 2002 now U.S. Pat. No. 6,672,368 entitled "Continuous Casting of Aluminum" which claims the benefit of U.S. Provisional Application Ser. No. 60/270,262 filed Feb. 20, 2001 entitled "Continuous Casting of Aluminum" and also claims the benefit of the following U.S. Provisional Applications: Ser. No. 60/405,333 filed Aug. 21, 2002 entitled "Magnesium Strip and Method of Continuous Casting Magnesium Base Alloys", Ser. No. 60/405,359 filed Aug. 21, 2002 entitled "Titanium Strip and Method of Continuous Casting Titanium Base Alloys", Ser. No. 60/406,453 filed Aug. 28, 2002 entitled "Casting of Non-Ferrous Metals", Ser. No. 60/406,504 filed Aug. 28, 2002 entitled "Continuous Casting of Aluminum Strip for Making Automotive Sheet", Ser. No. 60/406,505 filed Aug. 28, 2002 entitled "Continuous Casting of Aluminum Strip for Making Can Body Stock", Ser. No. 60/406,506 filed Aug. 28, 2002 entitled "Continuous Casting of Aluminum Strip for Making Can End and Tab Stock", and Ser. No. 60/406,507 filed Aug. 28, 2002 entitled "Continuous Casting Magnesium Base Alloys".

FIELD OF THE INVENTION

The present invention relates to casting of non-ferrous metal alloys, more particularly, to casting non-ferrous metal alloys to create a rapidly solidified shell or shells and a segregation-free center zone containing broken dendrites.

BACKGROUND OF THE INVENTION

Continuous casting of metals such as aluminum alloys is conventionally performed in twin roll casters, block casters and belt casters. Twin roll casting of aluminum alloys has enjoyed good success and commercial application despite the relatively low production rates achievable to date. Twin roll casting traditionally is a combined solidification and deformation technique involving feeding molten metal into the bite between a pair of counter-rotating cooled rolls wherein solidification is initiated when the molten metal contacts the rolls. Solidified metal forms as a "freeze front" of the molten metal within the roll bite and solid metal advances towards the nip, the point of minimum clearance between the rolls. The solid metal passes through the nip as a solid sheet. The solid sheet is deformed by the rolls (hot rolled) and exits the rolls.

Aluminum alloys have successfully been roll cast into ¼ inch thick sheet at about 4–6 feet per minute or about 50–70 pounds per hour per inch of cast width (lbs/hr/in). Attempts to increase the speed of roll casting typically fail due to centerline segregation. Although it is generally accepted that reduced gauge sheet (e.g., less than about ¼ inch thick) potentially could be produced more quickly than higher gauge sheet in a roll caster, the ability to roll cast aluminum at rates significantly above about 70 lbs/hr/in has been elusive.

Typical operation of a twin roll caster at thin gauges is described in U.S. Pat. No. 5,518,064 (incorporated herein by reference) and depicted in FIGS. 1 and 2. A molten metal holding chamber H is connected to a feed tip T which distributes molten metal M between water-cooled twin rolls $R_1$ and $R_2$ rotating in the direction of the arrows $A_1$ and $A_2$, respectively. The rolls $R_1$ and $R_2$ have respective smooth surfaces $U_1$ and $U_2$; any roughness thereon is an artifact of the roll grinding technique employed during their manufacture. The centerlines of the rolls $R_1$ and $R_2$ are in a vertical or generally vertical plane L (e.g., up to about 15° from vertical) such that the cast strip S forms in a generally horizontal path. Other versions of this method produce strip in a vertically upward direction. The width of the cast strip S is determined by the width of the tip T. The plane L passes through a region of minimum clearance between the rolls $R_1$ and $R_2$ referred to as the roll nip N. A solidification region exists between the solid cast strip S and the molten metal M and includes a mixed liquid-solid phase region X. A freeze front F is defined between the region X and the cast strip S as a line of complete solidification.

In conventional roll casting of aluminum alloys, the heat of the molten metal M is transferred to the rolls $R_1$ and $R_2$ such that the location of the freeze front F is maintained upstream of the nip N. In this manner, the molten metal M solidifies at a thickness greater than the dimension of the nip N. The solid cast strip S is deformed by the rolls $R_1$ and $R_2$ to achieve the final strip thickness. Hot rolling of the solidified strip between the rolls $R_1$ and $R_2$ according to conventional roll casting produces unique properties in the strip characteristic of roll cast aluminum alloy strip. In particular, a central zone through the thickness of the strip becomes enriched in eutectic forming elements (eutectic formers) in the alloy such as Fe, Si, Ni, Zn and the like and depleted in peritectic forming elements (Ti, Cr, V and Zr). This enrichment of eutectic formers (i.e., alloying elements other than Ti, Cr, V and Zr) in the central zone occurs because that portion of the strip S corresponds to a region of the freeze front F where solidification occurs last and is known as "centerline segregation". Extensive centerline segregation in the as-cast strip is a factor that restricts the speed of conventional roll casters. The as-cast strip also shows signs of working by the rolls. Grains which form during solidification of the metal upstream of the nip become flattened by the rolls. Therefore, roll cast aluminum includes grains elongated at an angle to the direction of rolling.

The roll gap at the nip N may be reduced in order to produce thinner gauge strip S. However, as the roll gap is reduced, the roll separating force generated by the solid metal between the rolls $R_1$ and $R_2$ increases. The amount of roll separating force is affected by the location of the freeze front F in relation to the roll nip N. As the roll gap is reduced, the percentage reduction of the metal sheet is increased, and the roll separating force increases. At some point, the relative positions of the rolls $R_1$ and $R_2$ to achieve the desired roll gap cannot overcome the roll separating force, and the minimum gauge thickness has been reached for that position of the freeze front F.

The roll separating force may be reduced by increasing the speed of the rolls in order to move the freeze front F downstream toward the nip N. When the freeze front is moved downstream (towards the nip N), the roll gap may be reduced. This movement of the freeze front F decreases the ratio between the thickness of the strip at the initial point of solidification and the roll gap at the nip N, thus decreasing the roll separating force as proportionally less solidified metal is being compressed and hot rolled. In this manner, as the position of the freeze front F moves toward the nip N, a proportionally greater amount of metal is solidified and then hot rolled at thinner gauges. According to conventional practice, roll casting of thin gauge strip is accomplished by first roll casting a relatively high gauge strip, decreasing the gauge until a maximum roll separating force is reached, advancing the freeze front to lower the roll separating force (by increasing the roll speed) and further decreasing the gauge until the maximum roll separating force is again reached, and repeating the process of advancing the freeze front and decreasing the gauge in an iterative manner until the desired thin gauge is achieved. For example, a 10 millimeter strip S may be rolled and the thickness may be reduced until the roll separating force becomes excessive (e.g., at 6 millimeters), necessitating a roll speed increase.

This process of increasing the roll speed can only be practiced until the freeze front F reaches a predetermined downstream position. Conventional practice dictates that the freeze front F not progress forward into the roll nip N to ensure that solid strip is rolled at the nip N. It has been generally accepted that rolling of a solid strip at the nip N is needed to prevent failure of the cast metal strip S being hot rolled and to provide sufficient tensile strength in the exiting strip S to withstand the pulling force of a downstream winder, pinch rolls or the like. Consequently, the roll separating force of a conventionally operated twin roll caster in which a solid strip of aluminum alloy is hot rolled at the nip N is on the order of several tons per inch of width. Although some reduction in gauge is possible, operation at such high roll separating forces to ensure deformation of the strip at the nip N makes further reduction of the strip gauge very difficult. The speed of a roll caster is restricted by the need to maintain the freeze front F upstream of the nip N and prevent centerline segregation. Hence, the roll casting speed for aluminum alloys has been relatively low.

Some reduction in roll separating force to obtain acceptable microstructure in aluminum alloys having high alloying element content is described in U.S. Pat. No. 6,193,818, incorporated herein by reference. Alloys having 0.5 to 13 wt. % Si are roll cast into strip about 0.05 to 0.2 inch thick at roll separating forces of about 5,000 to 40,000 lbs/in at speeds of about 5 to 9 feet per minute. While this represents an advance in roll separating force reduction, these forces still pose significant process challenges. Moreover, the productivity remains compromised and strip produced according to the '818 patent apparently exhibits some centerline segregation and grain elongation as shown in FIG. 3 thereof.

A major impediment to high-speed roll casting is the difficulty in achieving uniform heat transfer from the molten metal to the smooth surfaces $U_1$ and $U_2$, i.e., cooling of the molten metal. In actuality, the surfaces $U_1$ and $U_2$ include various imperfections which alter the heat transfer properties of the rolls. At high rolling speeds, such non-uniformity in heat transfer becomes problematic. For example, areas of the surfaces $U_1$ and $U_2$ with proper heat transfer will cool the molten metal M at the desired location upstream of the nip N whereas areas with insufficient heat transfer properties will allow a portion of the molten metal to advance beyond the desired location and create non-uniformity in the cast strip.

Thin gauge steel strip has been successfully roll cast in vertical casters at high speeds (up to about 400 feet per minute) and low roll separating forces. The rolls of a vertical roll caster are positioned side by side so that the strip forms in a downward direction. In this vertical orientation, molten steel is delivered to the bite between the rolls to form a pool of molten steel. The upper surface of the pool of molten steel is often protected from the atmosphere by means of an inert gas.

While vertical twin roll casting from a pool of molten metal is successful for steel, vertical casting of alloys sensitive to oxidation (e.g., aluminum) requires additional control. One suggestion for overcoming this problem of oxidized aluminum in vertical roll casting on a laboratory scale is described in Haga et al., "High Speed Roll Caster for Aluminum Alloy Strip", *Proceedings of ICAA*-6, Aluminum Alloys, Vol. 1, pp. 327–332 (1998). According to that method, a stream of molten aluminum alloy is ejected from a gas-pressurized nozzle directly onto one or both of the twin rolls in a vertical roll caster. Although high speed casting of aluminum alloy strip is reported, a major drawback to this technique is that the delivery rate of the molten aluminum alloy must be carefully controlled to ensure uniformity in the cast strip. When a single stream is ejected onto a roll, that stream is solidified into the strip. If a stream is ejected onto each roll, each stream becomes one half of the thickness of the cast strip. In both cases, any variation in the gas pressure or delivery rate of the molten aluminum alloy results in non-uniformity in the cast strip. The control parameters for this type of aluminum alloy roll casting are not practical on a commercial scale.

Continuous casting of aluminum alloys has been achieved on belt casters at rates of about 20–25 feet per minute at about ¾ inch (19 mm) gauge reaching a productivity level of about 1400 pounds per hour per inch of width. In conventional belt casting as described in U.S. Pat. No. 4,002,197, incorporated herein by reference, molten metal is fed into a casting region between opposed portions of a pair of revolving flexible metal belts. Each of the two flexible casting belts revolves in a path defined by upstream rollers located at one end of the casting region and downstream rollers located at the other end of the casting region. In this manner, the casting belts converge directly opposite each other around the upstream rollers to form an entrance to the casting region in the nip between the upstream rollers. The molten metal is fed directly into the nip. The molten metal is confined between the moving belts and is solidified as it is carried along. Heat liberated by the solidifying metal is withdrawn through the portions of the two belts which are adjacent to the metal being cast. This heat is withdrawn by cooling the reverse surfaces of the belts by means of rapidly moving substantially continuous films of water flowing against and communicating with these reverse surfaces.

The operating parameters for belt casting are significantly different from those for roll casting. In particular, there is no intentional hot rolling of the strip. Solidification of the metal is completed in a distance of about 12–15 inches (30–38 mm) downstream of the nip for a thickness of ¾ inch. The belts are exposed to high temperatures when contacted by molten metal on one surface and are cooled by water on the inner surface. This may lead to distortion of the belts. The tension in the belt must be adjusted to account for expansion or contraction of the belt due to temperature fluctuations in order to achieve consistent surface quality of the strip. Casting of aluminum alloys on a belt caster has been used to date mainly for products having minimal surface quality requirements or for products which are subsequently painted.

The problem of thermal instability of the belts is avoided in block casters. Block casters include a plurality of chilling blocks mounted adjacent to each other on a pair of opposing tracks. Each set of chilling blocks rotates in the opposite direction to form a casting region therebetween into which molten metal is delivered. The chilling blocks act as heat sinks as the heat of the molten metal transfers thereto. Solidification of the metal is complete about 12–15 inches downstream of the entrance to the casting region at a thickness of ¾ inch. The heat transferred to the chilling blocks is removed during the return loop. Unlike belts, the chilling blocks are not functionally distorted by the heat transfer. However, block casters require precise dimensional control to prevent gaps between the blocks which cause non-uniformity and defects in the cast strip.

This concept of transferring the heat of the molten metal to a casting surface has been employed in certain modified belt casters as described in U.S. Pat. Nos. 5,515,908 and 5,564,491, both incorporated herein by reference. In a heat sink belt caster, molten metal is delivered to the belts (the casting surface) upstream of the nip with solidification initiating prior to the nip and continued heat transfer from the metal to the belts downstream of the nip. In this system, molten metal is supplied to the belts along the curve of the upstream rollers so that the metal is substantially solidified by the time it reaches the nip between the upstream rollers. The heat of the molten metal and the cast strip is transferred to the belts within the casting region (including downstream of the nip). The heat is then removed from the belts while the belts are out of contact with either of the molten metal or the cast strip. In this manner, the portions of the belts within the casting region (in contact with the molten metal and cast strip) are not subjected to large variations in temperature as occurs in conventional belt casters. The thickness of the strip can be limited by the heat capacity of the belts between which casting takes place. Production rates of 2400 lbs/hr/in for 0.08–0.1 inch (2–2.5 mm) strip have been achieved.

However, problems associated with the belts used in conventional belt casting remain. In particular, uniformity of the cast strip depends on the stability of (i.e., tension in) the belts. For any belt caster, conventional or heat sink type, contact of hot molten metal with the belts and the heat transfer from the solidifying metal to the belts creates instability in the belts. Further, belts need to be changed at regular intervals which disrupts production.

Strip material of non-ferrous alloys are desirable for use as sheet product in the automotive and aerospace industries and in the production of can bodies and can end and tab stock. Conventional manufacturing of can body stock employs batch processes which include an extensive sequence of separate steps. When an ingot is needed for further processing, it is first scalped, heat treated to homogenize the alloy, cooled and rolled while still hot in a number of passes, hot finish rolled, and finally coiled, air cooled and stored. The coil may be annealed in a batch step. The coiled sheet stock is then further reduced to final gauge by cold rolling using unwinders, rewinders and single and/or tandem rolling mills. These batch processes typically used in the aluminum industry require many different material handling operations to move ingots and coils between what are typically separate processing steps.

Efforts to streamline production of can body stock are described in U.S. Pat. No. 4,260,419 via direct chill casting and U.S. Pat. No. 4,282,044 via minimill continuous strip casting. Both processes require many material handling operations to move ingots and coils. Such operations are labor intensive, consume energy and frequently result in product damage.

U.S. Pat. Nos. 5,772,802 and 5,772,799, incorporated herein by reference, disclose belt casting methods in which can or lid stock and a method for its manufacture in which a low alloy content aluminum alloy is strip cast to form a hot strip cast feedstock, the hot feedstock is rapidly quenched to prevent substantial precipitation, annealed and quenched rapidly to prevent substantial precipitation of alloying elements and then cold rolled. This process has been successful despite the relatively low production rates achievable to date.

In addition, alloys other than aluminum such as magnesium alloys have not been continuously cast on a commercial scale. Magnesium metal has a hexagonal crystal structure that severely restricts the amount of deformation that can be applied, particularly at low temperatures. Production of wrought magnesium alloy products is therefore normally carried out by hot working in the range of 300°–500° C. Even under those conditions, a multitude of rolling passes and intermediate anneals are needed. In the conventional ingot method, a total of up to 25 rolling passes with intermediate anneals are used to make a finished product of 0.5 mm gauge. As a result, magnesium wrought products tend to be expensive.

Accordingly, a need remains for a cost-effective method of casting of non-ferrous alloys that achieves uniformity in the cast surface.

SUMMARY OF THE INVENTION

This need is met by the method of the present invention of casting non-ferrous alloys which includes delivering molten non-ferrous alloy to a pair of spaced apart casting surfaces and rapidly cooling at least a portion of the non-ferrous alloy at a rate of at least about 100° C. per minute thereby solidifying an outer layer of the non-ferrous alloy surrounding an inner layer of a molten component and a solid component of dendrites. Suitable alloys include alloys of aluminum, alloys of magnesium, and alloys of titanium. The solidified outer layer increases in thickness as the alloy is cast. As the inner layer solidifies, the dendrites of the inner layer are altered, such as by breaking or detaching the dendrites into smaller structures. The product exiting the casting apparatus includes a solid inner layer containing altered dendrites (which substantially avoids or minimizes centerline segregation) surrounded by the outer solid layer of alloy. Depending on the casting apparatus, the product may be in the form of sheet, plate, slab, foil, wire, rod, bar or other extrusion. Suitable end products include automotive sheet product, aerospace sheet product, beverage can body stock and beverage can end and tab stock.

The casting surfaces may be the surfaces of rolls in a roll caster or surfaces of belts in a belt caster or other conventional spaced apart casting surfaces which approach each other. The step of solidifying the semi-solid layer is completed at a position of minimum distance between the casting surfaces. In one embodiment, the casting surfaces are surfaces of rotating rolls with a nip defined therebetween with completion of the solidifying step occuring at the nip. The force applied by the rolls to the metal advancing therebetween is a maximum of about 300 pounds per inch of width of the product. In another embodiment, the casting surfaces are surfaces of belts traveling over rotating rolls, the rolls defining a nip therebetween, and completion of the solidifying step occurs at the nip. The solidified product including the inner layer exits the position of minimum distance between the casting surfaces at a rate of about 25 to about 400 feet per minute or at a rate of at least about 100 feet per minute.

The present invention further includes product produced according to the method of the present invention. The product may be in the form of metal strip having a thickness of about 0.06 to about 0.25 inch. The thickness of the inner layer may constitute about 20 to about 30% of the thickness of the strip. One result of the process of the present invention is that the composition of the solidified inner layer of metal differs from the composition of the outer layers of metal. In addition, the broken dendrites of the inner layer of metal retain a globular (unworked) shape.

BRIEF DESCRIPTION OF THE DRAWINGS

A complete understanding of the invention will be obtained from the following description when taken in connection with the accompanying drawing figures wherein like reference characters identify like parts throughout.

DETAILED DESCRIPTION OF THE INVENTION

For purposes of the description hereinafter, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. When referring to any numerical range of values, such ranges are understood to include each and every number and/or fraction between the stated range minimum and maximum.

The present invention includes a method of casting non-ferrous alloy which includes delivering molten non-ferrous alloy to a casting apparatus. By non-ferrous alloy it is meant an alloy of an element such as aluminum, magnesium, titanium, copper, nickel, zinc or tin. Particularly suitable non-ferrous alloys for use in the present invention are aluminum alloys, magnesium alloys and titanium alloys.

The phrases "aluminum alloys", "magnesium alloys" and "titanium alloys" are intended to mean alloys containing at least 50 wt. % of the stated element and at least one modifier element. Aluminum, magnesium, and titanium alloys are considered attractive candidates for structural use in aerospace and automotive industries because of their light weight, high strength to weight ratio, and high specific stiffness at both room and elevated temperatures. Suitable aluminum alloys include alloys of the Aluminum Association 3xxx and 5xxx series. Examples of systems of magnesium based alloys are Mg—Al system; Mg—Al—Zn system; Mg—Al—Si system; Mg—Al-Rare Earth (RE) system; Mg—Th—Zr system; Mg—Th—Zn—Zr system; Mg—Zn—Zr system; and Mg—Zn—Zr-RE system.

Figure 3:
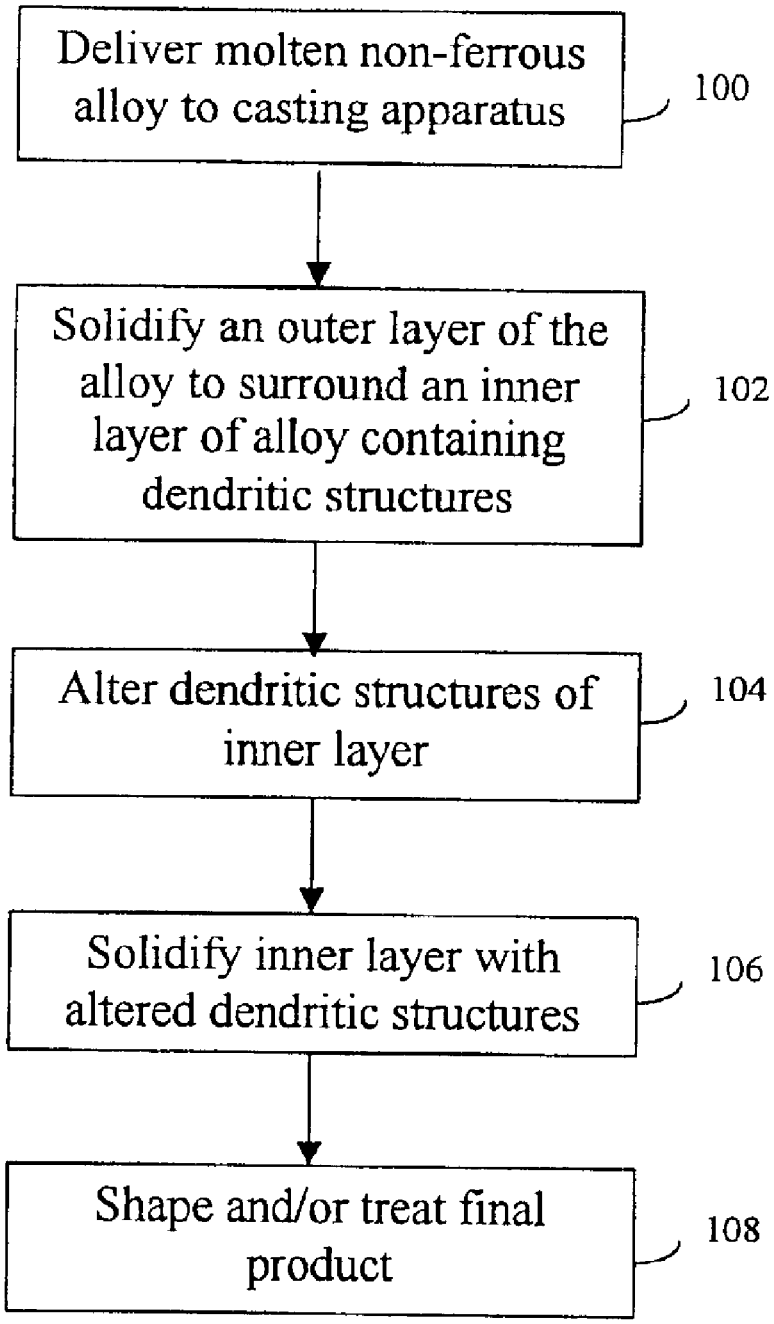
FIG. 3 is flow chart of steps of the casting method of the present invention.

The invention in its most basic form is depicted schematically in the flow chart of FIG. 3. In step 100, molten non-ferrous metal is delivered to a casting apparatus. The casting apparatus includes a pair of spaced apart advancing casting surfaces such as described in detail below. In step 102, the casting apparatus rapidly cools at least a portion of the non-ferrous alloy to solidify an outer layer of the non-ferrous alloy while maintaining a semi-solid inner layer. The inner layer includes a molten metal component and a solid component of dendrites of the metal. The solidified outer layer increases in thickness as the alloy is cast. The dendrites of the inner layer are altered in step 104, such as by breaking the dendrites into smaller structures. In step 106, the inner layer is solidified. The product exiting the casting apparatus includes the solid inner layer formed in step 106 containing the broken dendrites sandwiched within the outer solid layer of alloy. The product may be in various forms such as but not limited to sheet, plate, slab, and foil. For extrusion type casting, the product may be in the form of a wire, rod, bar or other extrusion. In either case, the product may be further processed and/or treated in step 108. The order of steps 100–108 are not fixed in the method of the present invention and may occur sequentially or some of the steps may occur simultaneously.

The present invention balances the rate of solidification of the molten metal, the formation of dendrites in the solidifying metal and alteration of the dendrites to obtain desired properties in the final product. The cooling rate is selected to achieve rapid solidification of the outer layers of the metal. For aluminum alloys and other non-ferrous alloys, cooling of the outer layers of metal may occur at a rate of at least about 100° C. per minute. Suitable casting apparatuses include cooled casting surfaces such as in a twin roll caster, a belt caster, a slab caster, or a block caster. Vertical roll casters may also be used in the present invention. In a continuous caster, the casting surfaces generally are spaced apart and have a region at which the distance therebetween is at a minimum. In a roll caster, the region of minimum distance between casting surfaces is the nip. In a belt caster, the region of minimum distance between casting surfaces of the belts may be the nip between the entrance pulleys of the caster. As is described in more detail below, operation of a casting apparatus in the regime of the present invention involves solidification of the metal at the location of a minimum distance between the casting surfaces. While the method of present invention is described below as performed using a twin roll caster, this is not meant to be limiting. Other continuous casting surfaces may be used to practice the invention.

Figure 1:
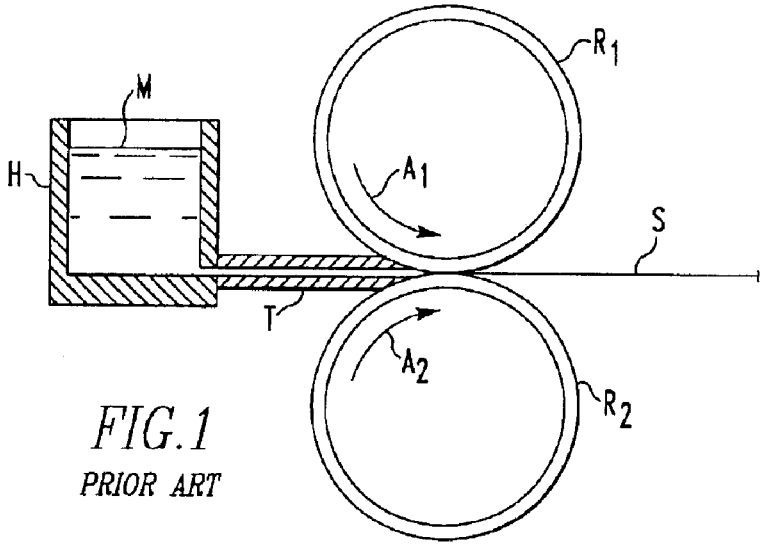
FIG.1 PRIOR ART
FIG. 1 is a schematic of a portion of a caster with a molten metal delivery tip and a pair of rolls.
Figure 2:
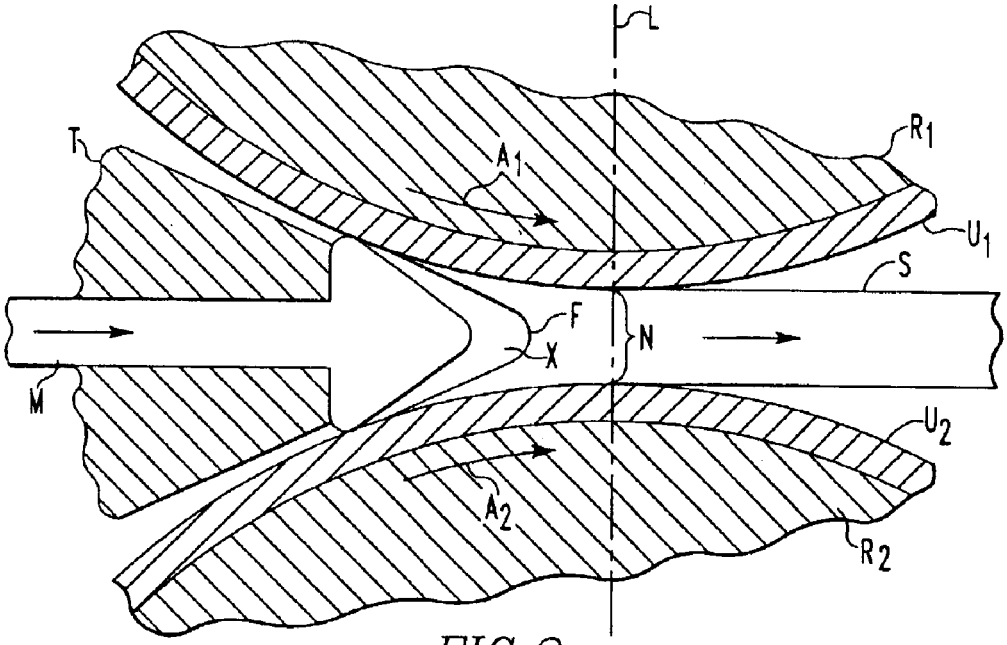
FIG.2 PRIOR ART
FIG. 2 is an enlarged cross-sectional schematic of the molten metal delivery tip and rolls shown in FIG. 1 operated according to the prior art.
Figure 4:
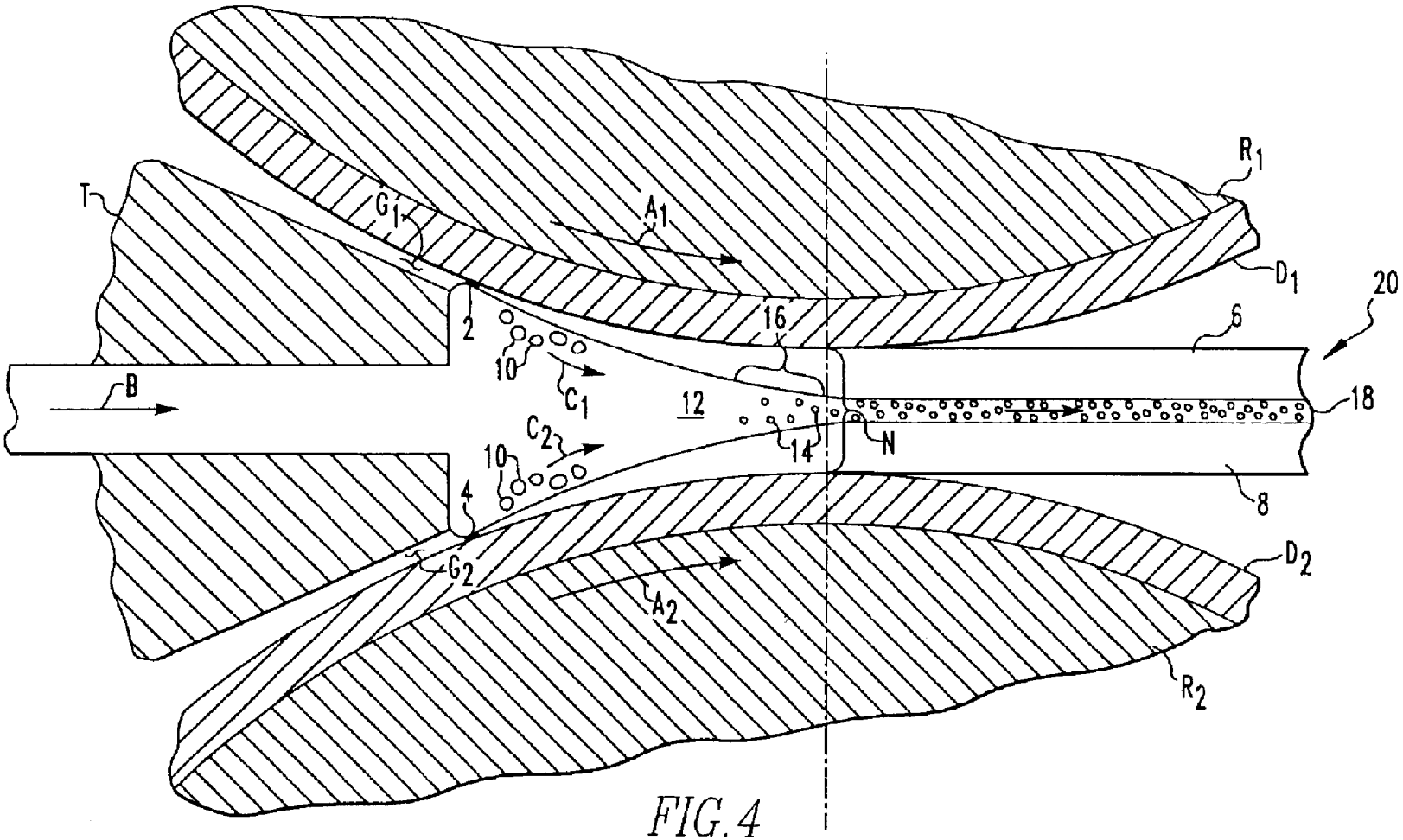
FIG. 4 is a schematic of molten metal casting operated according to the present invention.

By way of example, a roll caster (FIG. 1) may be operated to practice the present invention as shown in detail in FIG. 4. Referring to FIG. 1 (which genericallydepicts horizontal continuous casting according to the prior art and according to the present invention), the present invention is practiced using a pair of counter-rotating cooled rolls $R_1$ and $R_2$ rotating in the directions of the arrows $A_1$ and $A_2$, respectively. By the term horizontal, it is meant that the cast strip is produced in a horizontal orientation or at an angle of plus or minus about 30° from horizontal. As shown in more detail in FIG. 4, a feed tip T, which may be made from a refractory or other ceramic material, distributes molten metal M in the direction of arrow B directly onto the rolls $R_1$ and $R_2$ are maintained as small as possible to prevent molten metal from leaking out and to minimize the exposure of the molten metal to the atmosphere along the rolls $R_1$ and $R_2$ yet avoid contact between the tip T and the rolls $R_1$, and $R_2$. A suitable dimension of the gaps $G_1$ and $G_2$ is about 0.01 inch (0.25 mm). A plane L through the centerline of the rolls $R_1$, and $R_2$ passes through a region of minimum clearance between the rolls $R_1$, and $R_2$ referred to as the roll nip N.

Molten metal M is provided to the casting surfaces of the roll caster, the cooled rolls $R_1$ and $R_2$. The molten metal M directly contacts the rolls $R_1$ and $R_2$ at regions 2 and 4, respectively. Upon contact with the rolls $R_1$ and $R_2$, the metal M begins to cool and solidify. The cooling metal solidifies as an upper shell 6 of solidified metal adjacent the roll $R_1$ and a lower shell 8 of solidified metal adjacent to the roll $R_2$. The thickness of the shells 6 and 8 increases as the metal M advances towards the nip N. Large dendrites 10 of solidified metal (not shown to scale) are produced at the interfaces between each of the upper and lower shells 6 and 8 and the molten metal M. The large dendrites 10 are broken and dragged into a center portion 12 of the slower moving flow of the molten metal M and are carried in the direction of arrows $C_1$ and $C_2$. The dragging action of the flow can cause the large dendrites 10 to be broken further into smaller dendrites 14 (not shown to scale). In the central portion 12 upstream of the nip N referred to as region 16, the metal M is semi-solid and includes a solid component (the solidified small dendrites 14) and a molten metal component. The metal M in the region 16 has a mushy consistency due in part to the dispersion of the small dendrites 14 therein. At the location of the nip N, some of the molten metal is squeezed backwards in a direction opposite to the arrows $C_1$ and $C_2$. The forward rotation of the rolls $R_1$ and $R_2$ at the nip N advances substantially only the solid portion of the metal (the upper and lower shells 6 and 8 and the small dendrites 14 in the central portion 12) while forcing molten metal in the central portion 12 upstream from the nip N such that the metal is completely solid as it leaves the point of the nip N. Downstream of the nip N, the central portion 12 is a solid central layer 18 containing the small dendrites 14 sandwiched between the upper shell 6 and the lower shell 8. In the central layer 18, the small dendrites 14 may be about 20 to about 50 microns in size and have a generally globular shape. In a strip product, the solid inner portion may constitute about 20 to about 30 percent of the total thickness of the strip. While the caster of FIG. 4 is shown as producing strip S in a generally horizontal orientation, this is not meant to be limiting as the strip S may exit the caster at an angle or vertically.

The casting process described in relation to FIG. 4 follows the method steps outlined above. Molten metal delivered in step 100 to the roll caster begins to cool and solidify in step 102. The cooling metal develops outer layers of solidified metal 6 and 8 near or adjacent the cooled casting surfaces ($R_1$ and $R_2$). The thickness of the solidified layers 6 and 8 increases as the metal advances through the casting apparatus. Per step 102, dendrites 10 form in the metal in an inner layer 12 that is at least partially surrounded by the solidified outer layers 6 and 8. In FIG. 4, the outer layers 6 and 8 substantially surround the inner layer 12 as a sandwich of the inner layer 12 between the two outer layers 6 and 8. In other casting apparatuses the outer layer may completely surround the inner layer. In step 104, the dendrites 10 are altered, e.g., broken into smaller structures 14. In the inner layer 12 prior to complete solidification of the metal, the metal is semi-solid and includes a solid component (the solidified small dendrites 14) and a molten metal component. The metal at this stage has a mushy consistency due in part to the dispersion of the small dendrites 14 therein. In step 106 at the location of complete solidification of the metal in the casting apparatus, the solidified product includes an inner portion 18 containing the small dendrites 14 at least partially surrounded by an outer portion. The thickness of the inner portion may be about 20 to about 30 percent of the thickness of the product. In the inner portion, the small dendrites may be about 20 to about 50 microns in size and are substantially unworked by the casting apparatus and thus have a generally globular shape.

According to the present invention, molten metal in the inner layer 12 is squeezed in a direction opposite to its flow through a casting apparatus (as described in reference to casting between rolls) and/or may be forced into the outer layers 6 and 8 and reach the exterior surfaces of the outer layers 6 and 8. This feature of squeezing and/or forcing the molten metal in the inner layer occurs in any of the casting apparatuses described herein.

Breakage of the dendrites in the inner layer in step 104 is achieved when casting between rolls by the shear forces resulting from speed differences between the inner layer of molten metal and the outer layer. Roll casters operated at conventional speeds of less than 10 feet per minute do not generate the shear forces required to break any such dendrites. While high speed (at least 25 feet per minute) operation of a conventional roll caster with control of solidification as described above allows for casting in the regime of the present invention, other conventional casting apparatuses may also be adapted for operating in a manner which results in the process of the invention. An important aspect of the present invention is breakage of dendrites in the inner layer. Breakage of the dendrites minimizes or avoids centerline segregation and results in improved formability and elongation properties in the finished product by virtue of the reduction or absence of coarse constituents as would be present in conventional roll cast or belt cast product exhibiting centerline segregation. Other suitable mechanisms for breaking dendrites in the inner layer include application to the liquid of mechanical stirring (e.g., propeller), electromagnetic stirring including rotational stator stirring and linear stator stirring, and high frequency ultrasonic vibration.

The casting surfaces serve as heat sinks for the heat of the molten metal. In the present invention, heat is transferred from the molten metal to the cooled casting surface in a uniform manner to ensure uniformity in the surface of the cast product. The cooled casting surfaces may be made from steel or copper and may be textured and include surface irregularities which contact the molten metal. The surface irregularities may serve to increase the heat transfer from the surfaces of the cooled casting surfaces. Imposition of a controlled degree of non-uniformity in the surfaces of the cooled casting surfaces can result in uniform heat transfer across the surfaces thereof. The surface irregularities may be in the form of grooves, dimples, knurls or other structures and may be spaced apart in a regular pattern of about 20 to about 120 surface irregularities per inch or about 60 irregularities per inch. The surface irregularities may have a height of about 5 to about 50 microns or about 30 microns. The cooled casting surfaces may be coated with a material such as chromium or nickel to enhance separation of the cast product therefrom.

The casting surfaces generally heat up during casting and are prone to oxidation at elevated temperatures. Non-uniform oxidation of the casting surfaces during casting can change the heat transfer properties thereof. Hence, the casting surfaces may be oxidized prior to use to minimize changes thereof during casting. Brushing the casting surfaces from time to time or continuously is beneficial in removing debris which builds up during casting of non-ferrous alloys. Small pieces of the cast product may break free from the product and adhere to the casting surfaces. These small pieces of non-ferrous alloy product are prone to oxidation, which result in non-uniformity in the heat transfer properties of the casting surfaces. Brushing of the casting surfaces avoids the non-uniformity problems from debris which may collect on the casting surfaces.

In a roll caster operated in the regime of the present invention, the control, maintenance and selection of the appropriate speed of the rolls $R_1$ and $R_2$ may impact the operability of the present invention. The roll speed determines the speed that the molten metal M advances towards the nip N. If the speed is too slow, the large dendrites 10 will not experience sufficient forces to become entrained in the central portion 12 and break into the small dendrites 14. Accordingly, the present invention is suited for operation at high speeds such as about 25 to about 400 feet per minute or about 100 to about 400 feet per minute or about 150 to about 300 feet per minute. The linear rate per unit area that molten aluminum is delivered to the rolls $R_1$ and $R_2$ may be less than the speed of the rolls $R_1$ and $R_2$ or about one quarter of the roll speed. High-speed continuous casting according to the present invention may be achievable in part because the textured surfaces $D_1$ and $D_2$ ensure uniform heat transfer from the molten metal M.

The roll separating force may be an important parameter in practicing the present invention. A significant benefit of the present invention is that solid strip is not produced until the metal reaches the nip N. The thickness is determined by the dimension of the nip N between the rolls $R_1$ and $R_2$. The roll separating force may be sufficiently great to squeeze molten metal upstream and away from the nip N. Excessive molten metal passing through the nip N may cause the layers of the upper and lower shells 6 and 8 and the solid central portion 18 to fall away from each other and become misaligned. Insufficient molten metal reaching the nip N causes the strip to form prematurely as occurs in conventional roll casting processes. A prematurely formed strip 20 may be deformed by the rolls $R_1$ and $R_2$ and experience centerline segregation. Suitable roll separating forces are about 25 to about 300 pounds per inch of width cast or about 100 pounds per inch of width cast. In general, slower casting speeds may be needed when casting thicker gauge non-ferrous alloy in order to remove the heat from the thick alloy. Unlike conventional roll casting, such slower casting speeds do not result in excessive roll separating forces in the present invention because fully solid non-ferrous strip is not produced upstream of the nip.

Non-ferrous alloy strip may be produced at thicknesses of about 0.1 inch or less (e.g., 0.06 inch) at casting speeds of about 25 to about 400 feet per minute. Thicker gauge non-ferrous alloy strip may also be produced using the method of the present invention, for example at a thickness of about 0.25 inch. Casting at linear rates contemplated by the present invention (i.e., about 25 to about 400 feet per minute) solidifies the non-ferrous alloy product about 1000 times faster than non-ferrous alloy cast as an ingot and improves the properties of the product over non-ferrous alloys cast as an ingot.

The present invention further includes non-ferrous alloy product cast according to the present invention. The non-ferrous alloy product includes an inner portion substantially surrounded by an outer portion. The concentration of alloying elements may differ between the inner portion and the outer portion. The molten alloy may have an initial concentration of alloying elements including peritectic forming alloying elements and eutectic forming alloying elements. The concentration of alloying elements may differ between the outer portion and the inner portion. The inner portion of the product may be depleted in certain elements (such as eutectic formers) and enriched in other elements (such as peritectic formers) in comparison to the concentration of the eutectic formers and the peritectic formers in each of the metal and the outer portion. The grains in the non-ferrous alloy product of the present invention are substantially undeformed, i.e., have an equiaxial structure, such as globular. In the absence of hard particles in the inner portion of the product, centerline segregation and cracking typical in many cast non-ferrous alloys is minimized or avoided.

Figure 5:
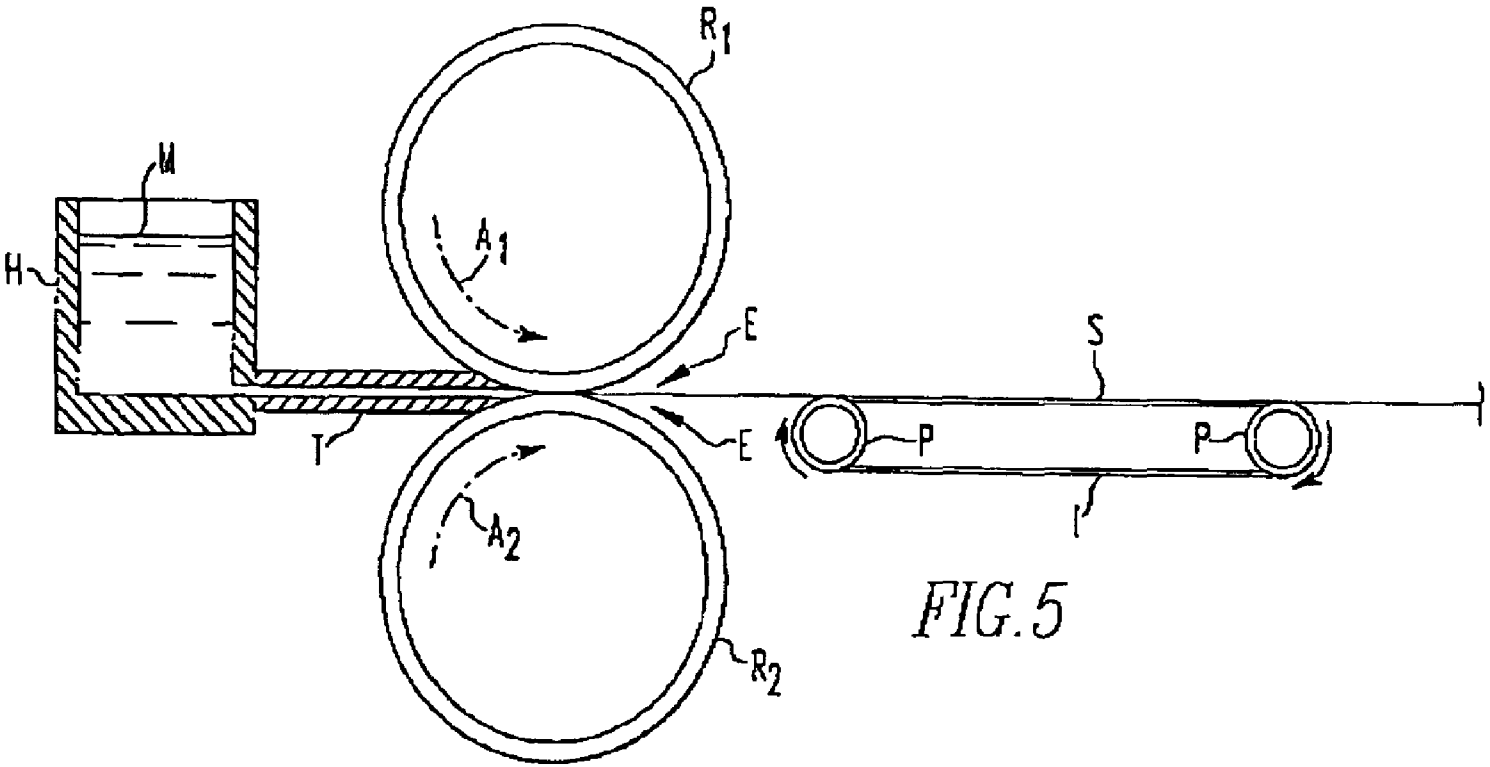
FIG. 5 is a schematic of a caster made in accordance with the present invention with a strip support mechanism and optional cooling means.
Figure 6:
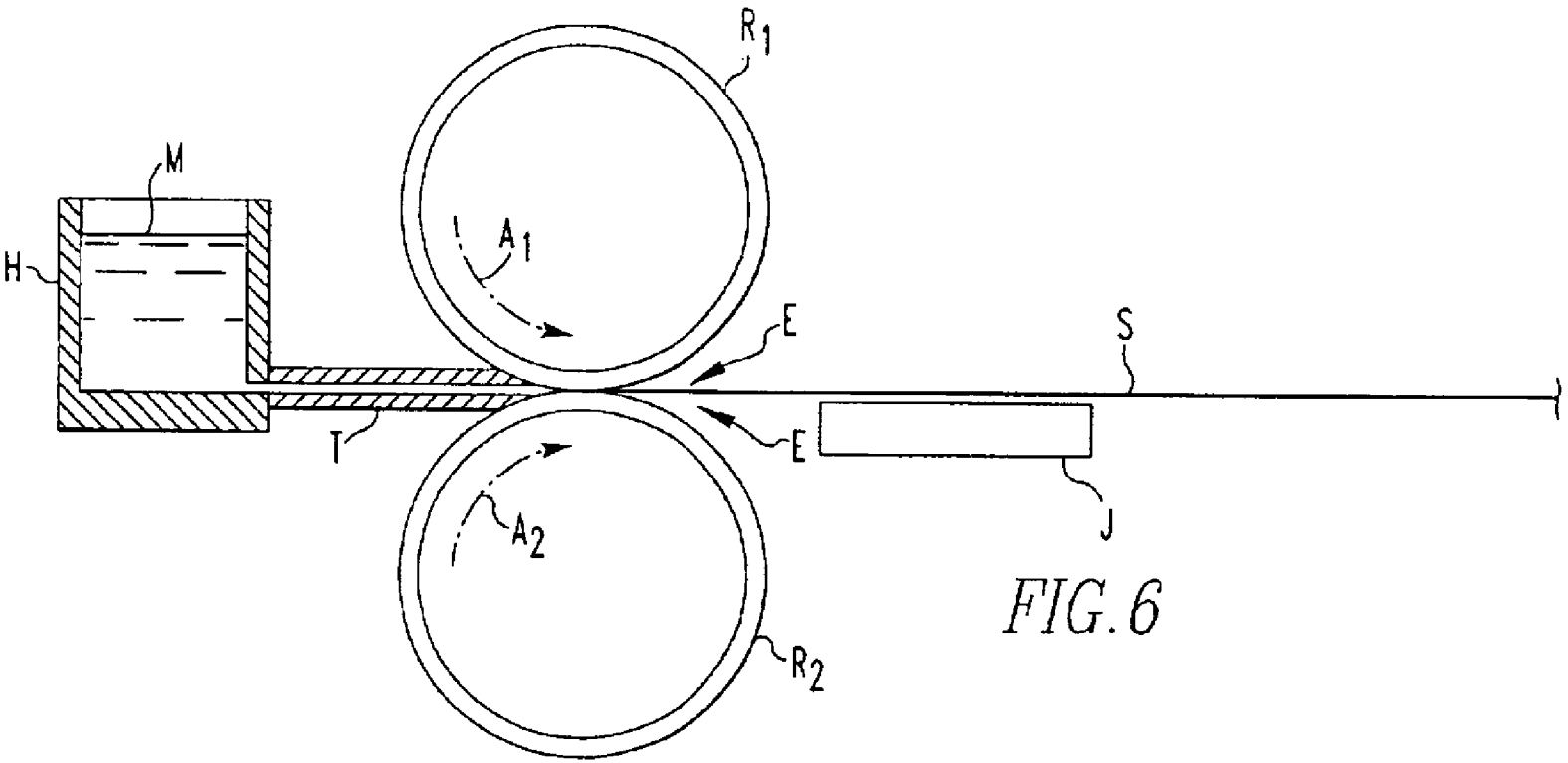
FIG. 6 is a schematic of a caster made in accordance with the present invention with another strip support mechanism and optional cooling means.

In practicing the present invention, it may be beneficial to support product exiting the casting apparatus until the product cools sufficiently to be self-supporting. One support mechanism shown in FIG. 5 includes a continuous conveyor belt I positioned beneath a strip S exiting rolls $R_3$ and $R_2$. The belt I travels around pulleys P and supports the strip S for a distance that may be about 10 feet. The length of the belt B between tho pulleys P may be determined by the casting process, the exit temperature of the strip S and the alloy of the strip S. Suitable materials for the belt I include fiberglass and metal (e.g., steel) in solid form or as a mesh. Alternatively, as shown in FIG. 6, the support mechanism may include a stationary support surface J such as a metal shoe over which the strip S travels while it cools. The shoe J may be made of a material to which the hot strip S does not readily adhere. In certain instances where the strip S is subject to breakage upon exiting the rolls $R_1$ and $R_2$, the strip S may be cooled at locations E with a fluid such as air or water. Typically for aluminum alloys, the strip S exits the rolls $R_1$ and $R_2$ at about 1100° F., and it may be desirable to lower the aluminum alloy strip temperature to about 1000° F. within about 8 to 10 inches of the nip N. One suitable mechanism for cooling the strip at locations E to achieve that amount of cooling is described in U.S. Pat. No. 4,832,860, incorporated herein by reference.

EXAMPLES

An aluminum alloy containing by wt. % 0.75 Si, 0.20 Fe, 0.80 Cu, 0.25 Mn and 2.0 Mg was cast according to the present invention and then hot and cold rolled in-line to 0.015 inch gauge. The resultant properties for two products are listed in Table 1. Example 1 shows properties obtained in the as-rolled condition after coil cooling. The combination of high strength and good formability (elongation) is notable. The combination of high yield strength and elongation achieved in Examples 1 and 2 has heretofore not been achieved in 5xxx series aluminum-magnesium alloys. By way of comparison, aluminum alloy 5182, at best, has a yield strength of 54 ksi and elongation of 7%. Example 2 shows properties obtained after the sheet was solution heat treated and aged at 275° F. in the laboratory. Good yield strength and superior bending properties were achieved.

TABLE 1

| Property | Example 1 | Example 2 |
|---|---|---|
| Yield strength (ksi) | 60 | 43 |
| UTS (ksi) | 65 | 55 |
| Elongation (%) | 10 | 16 |
| Bend radius (r/t) | 1.7 | 0.3* |
| Ludering lines | none | none |
| Olsen height (in)-lubricated | 0.195 | — |
| Corrosion | — | — |
| Orange peel | none | none |
| Finish | semi-bright | mill |
| O-temper | yes | yes |

*Flat hem

By practicing the method of the present invention, non-ferrous cast alloy products may be produced with improved yield strength and elongation compared to conventional cast products. Such improved properties allow for production of thinner product that is desirable in the market.

The product exiting the casting apparatus may be shaped, such as by subsequent rolling, into another form or otherwise treated to manufacture can sheet, tab stock, automotive sheet and other end products including lithographic sheet and bright sheet. Subsequent processing of the product exiting the casting apparatus may be done by in-line rolling to benefit from the heat in the as-cast sheet (per the following U.S. Pat. Nos., each incorporated herein by reference: U.S. Pat. Nos. 5,772,799; 5,772,802; 5,356,495; 5,496,423; 5,514,228; 5,470,405; 6,344,096 and 6,280,543). Alternatively, the as-cast sheet may be cooled and rolled subsequently off-line. Other processing of the sheet may be performed according to one or more of the aforesaid patents.

Whereas the preferred embodiments of the present invention have been described above in terms of being especially valuable in producing non-ferrous alloy parts for the automotive and aerospace industries and the beverage can industries, it will be apparent to those skilled in the art that the present invention will also be valuable for producing parts such as boats, canoes, skis, pianos, harps, delivery truck bodies, truck cabs, buses, trash collectors bins, racing boat hulls, private aircraft parts, fire truck hose containers, material handling equipment, dock boards, portable ramps, aerospace equipment parts, including rockets and satellites, radar tracking systems, electronic equipment cabinets, vibratory screens, tote bins, luggage frames and sides, ladders, water heater anodes, typewriters, rocket launchers and mortar bases, textile machinery parts, concrete buckets and hand finishing tools, jigs and fixtures and vibration testing machines.

Whereas the preferred embodiments of the present invention have been described above in terms of being especially valuable in horizontal casting of non-ferrous base alloys, it will be apparent to those skilled in the art that the present invention will also be valuable in vertical casting as well as any angle between vertical and horizontal casting.

Whereas the preferred embodiments of the present invention have been described above in terms of aluminum metal strip product exiting the casting apparatus that includes a solid inner layer containing altered dendritic structures substantially surrounded by the outer solid layer of alloy, the product may be in the form of sheet, plate, slab, foil, wire, rod, bar or extrusion.

Whereas the preferred embodiments of the present invention have been described above in terms of using the nip of twin rolls to break dendrites that form as the metal solidifies, that is aluminum metal, it will be apparent to those skilled in the art that the present invention will also be valuable with other non-ferrous metals including, titanium, magnesium, nickel, zinc, tin and copper.

What is claimed is:

1. A strip of non-ferrous alloy comprising:

a pair of outer layers of a non-ferrous alloy; and a central layer of said non-ferrous alloy positioned between said outer layers and comprising globular dendrites, said outer layers and said central layer having been produced into a strip by continuous casting of a melt of said non-ferrous alloy composition.

2. The strip of claim 1 wherein the thickness of said strip is about 0.06 to about 0.25 inch.

3. The strip of claim 2 wherein the thickness of said central layer comprises about 20 to about 30 percent of the thickness of said strip.

4. The strip of claim 2 wherein said globular dendrites are unworked.

5. The strip of claim 1 wherein said strip was produced by continuous casting of a melt of said non-ferrous alloy composition between a pair of rotating rolls.

6. The strip of claim 1 wherein said non-ferrous alloy is an alloy of aluminum.

7. The strip of claim 1 wherein said non-ferrous alloy is an alloy of magnesium.

8. The strip of claim 1 wherein said non-ferrous alloy is an alloy of titanium.

9. The strip of claim 1 wherein said strip comprises automotive sheet product.

10. The strip of claim 1 wherein said strip comprises aerospace shoot product.

11. The strip of claim 1 wherein said strip comprises beverage can body stock.

12. The strip of claim 1 wherein said the strip comprises beverage can end stock or beverage can tab stock.

13. A method of continuously casting molten metal into the strip of non-ferrous alloy according to claim 1 comprising the steps of:

providing non-ferrous molten metal to a pair of spaced apart advancing casting surfaces;

solidifying the molten metal on the casting surfaces while advancing the metal between the casting surfaces to produce solid metal outer layers adjacent the casting surfaces and a semi-solid inner layer containing dendrites of the metal between the solid metal outer layers;

breaking the dendrites in the inner layer;

solidifying the semi-solid inner layer to produce a solid metal product comprised of the inner layer and the outer layers; and withdrawing the solid metal product from between the casting surfaces.

14. The method of claim 13 wherein the casting surfaces are surfaces are surfaces of a roll or belt.

15. The method of claim 13 wherein the casting surfaces approach each other and said step of solidifying the semi-solid layer is completed at a position of minimum distance between the casting surfaces.

16. The method of claim 15 wherein the casting surfaces are surfaces of rotating rolls with a nip defined therebetween, such that completion of said solidifying step occurs at the nip.

17. The method of claim 16 wherein the product exits the nip at a rate of about 25 to about 400 feet per minute.

18. The method of claim 17 wherein the force applied by the rolls to the metal advancing therebetween is a maximum of about 300 pounds per inch of width of the product.

19. The method of claim 16 wherein the product exits the nip at a rate of at least about 100 feet per minute.

20. The method of claim 15 wherein the casting surfaces are surfaces of belts traveling over rotating rolls, the rolls defining a nip therebetween, and completion of said solidifying step occurs at the nip.

21. The method of claim 13 wherein the product comprises a metal strip having a thickness of about 0.06 to about 0.25 inch.

22. The method of claim 13 wherein the metal is an alloy of aluminum.

23. The method of claim 13 wherein the metal is an alloy of magnesium.

24. The method of claim 13 wherein the metal is an alloy of titanium.

25. The method of claim 13 wherein the composition of the solidified inner layer of metal is different from the composition of the other layers of metal.

26. The method of claim 13 further comprising a step of in-line rolling the withdrawn solid metal product.

27. The method of claim 13 further comprising a step of off-line rolling the withdrawn solid metal product.

28. The method of claim 13 wherein the metal product comprises automotive sheet product.

29. The method of claim 13 wherein the metal product comprises aerospace sheet product.

30. The method of claim 13 wherein the metal product comprises beverage can body stock.

31. The method of claim 13 wherein the metal product comprises beverage can end stock or beverage can tab stock.

* * * * *

UNITED STATES PATENT AND TRADEMARK OFFICE

CERTIFICATE OF CORRECTION

PATENT NO. : 7,125,612 B2
APPLICATION NO. : 10/461704
DATED : October 24, 2006
INVENTOR(S) : Ali Ünal It is certified that error appears in the above-identified patent and that said Letters Patent is hereby corrected as shown below:

In column 8, line 54, after "$R_2$" insert --rotating in the direction of the arrows $A_1$ and $A_2$, respectively. Gaps $G_1$ and $G_2$ between the feed tip T and the respective rolls $R_1$ and $R_2$--.

In column 14, line 11, line 2 of Claim 10, after "aerospace", delete "shoot" and insert --sheet--.

In column 14, line 34, line 2 of Claim 14, after the first occurrence of "surfaces", delete "are surfaces".

Signed and Sealed this

Twenty-fifth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,125,612 B2
APPLICATION NO. : 10/461704
DATED : October 24, 2006
INVENTOR(S) : Ali Ünal It is certified that error appears in the above-identified patent and that said Letters Patent is hereby corrected as shown below:

On the title page, under Related U.S. Application Data, Item (60), after "Provisional application No. 60/270,262, filed on Feb. 20, 2001", add --and also Provisional application No. 60/405,333, filed on August 21, 2002; Provisional application No. 60/405,359, filed on August 21, 2002; Provisional application No. 60/406,453, filed on August 28, 2002, Provisional Application No. 60/406,504, filed on August 28, 2002, Provisional application No. 60/406,505, filed on August 28, 2002; Provisional Application No. 60/406,506, filed on August 28, 2002; and Provisional Application No. 60/406,507, filed on August 28, 2002--.

Signed and Sealed this

Eleventh Day of November, 2008

JON W. DUDAS
*Director of the United States Patent and Trademark Office*